US009889386B2

(12) United States Patent
Lian

(10) Patent No.: US 9,889,386 B2
(45) Date of Patent: Feb. 13, 2018

(54) CONNECTION STRUCTURE FOR TOY TRACK

(71) Applicant: ZHEJIANG ZONXIE ART & CRAFT CO., LTD., Yunhe County, Zheijang (CN)

(72) Inventor: Qiaozhong Lian, Zhejiang (CN)

(73) Assignee: ZHEJIANG ZONXIE ART & CRAFT CO., LTD., Yunhe County, Zhejiang (CN)

( * ) Notice: Subject to any disclaimer, the term of this patent is extended or adjusted under 35 U.S.C. 154(b) by 99 days.

(21) Appl. No.: 14/909,886

(22) PCT Filed: Apr. 9, 2015

(86) PCT No.: PCT/CN2015/076186
§ 371 (c)(1),
(2) Date: Feb. 3, 2016

(87) PCT Pub. No.: WO2016/145700
PCT Pub. Date: Sep. 22, 2016

(65) Prior Publication Data

US 2017/0036128 A1 Feb. 9, 2017

(30) Foreign Application Priority Data

Mar. 18, 2015 (CN) ..... 2015 2 0154831 U

(51) Int. Cl.
*A63H 19/30* (2006.01)

(52) U.S. Cl.
CPC ..... *A63H 19/30* (2013.01)

(58) Field of Classification Search
CPC ..... A63H 19/30
USPC ..... 238/10 R
See application file for complete search history.

(56) References Cited

U.S. PATENT DOCUMENTS 5,392,987 A * 2/1995 Ropers ..... A63H 19/36 104/111
5,868,076 A * 2/1999 Myus ..... A63H 18/16 104/60
6,601,774 B1 8/2003 Kasimoff

FOREIGN PATENT DOCUMENTS

CN 103990286 A 8/2014
CN 103990287 A 8/2014
CN 203886186 U 10/2014
CN 203886187 U 10/2014

* cited by examiner

*Primary Examiner* — Zachary L Kuhfuss
(74) *Attorney, Agent, or Firm* — Global IP Services; Tianhua Gu

(57) ABSTRACT

A connection structure for a toy track, comprising at least two groups of tracks, each group of tracks being formed by splicing a plurality of track units, sides of adjacent groups of tracks being spliced by an immediately detachable connecting member. By splicing sides of a plurality of groups of tracks by connecting members in an immediately detachable manner, a lot of consumption of material of large size may be avoided, and especially for wooden toys, the selection range of wood raw material is increased while effectively reducing the cost, which is advantageous for sustainable development; in addition, mating toy modules such as guideboards, signal lamps, building modules and natural landscape modules may be spliced together, and those modules not only play a role of decoration, but also greatly improve the attractiveness of this toy track.

7 Claims, 3 Drawing Sheets

CONNECTION STRUCTURE FOR TOY TRACK

CROSS REFERENCE TO RELATED PATENT APPLICATION

The present application is the US national stage of PCT/CN2015/076186 filed on Apr. 9, 2015 which claims the priority of the Chinese patent applications No. 201520154831.4 filed on Mar. 18, 2015, which applications are incorporated herein by reference.

TECHNICAL FIELD OF THE INVENTION

The present invention relates to the field of toys, especially to a track model for allowing a toy car to run thereon, in particular to a connection structure for a toy track.

BACKGROUND OF THE INVENTION

Toys generally refer to articles available for playing. Playing with toys is usually regarded as a way of teaching together with pleasure in human society. There is a wide variety of toys, among which, toy tracks may train meticulous manipulation, logical thinking, coordination of hands and eyes, visual sense, etc.

At present, the commercially available toy tracks, generally made of wood, metal or plastic, are usually manufactured by end-to-end splicing a plurality of track units each having a tenon at one end and a mortise at the other end. For these toy tracks, their appearances and shapes are often designed by simulating the running environments of a real car, where toy modules such as bridges, mountains, tunnels, stations and buildings, which are commonly encountered on real roads, will be usually provided in a combination manner to make the effect more realistic.

However, the majority of those existing toy tracks are track models having a single running trajectory. In addition, there are few toy tracks having a plurality of running trajectories and a plurality of paths in the market, but the main feature of these toy tracks is realized by forming a plurality of grooves as running tracks on a single track unit. That is, a large raw material block is required for grooving. Especially for wooden toy tracks, processing such multi-path toy tracks results in waste of a lot of wood blocks of large size, and it is difficult to control the quality. Over time, it is disadvantageous for sustainable development. In addition, such toy tracks having a plurality of running trajectories are relatively fixed and monotonous in both structure and form, leads to low variability as they can not be split into a plurality of tracks having a single running trajectory when in use. This really reduces the attractiveness of toys and is difficult to attract children to play with such toy tracks for a long term. Moreover, the mating toy modules of the existing toy tracks, such as bridges, mountains, tunnels, stations and buildings, as they are just placed near the toy tracks when in use without any corresponding splicing relationship therebetween, play a role of decoration only instead of training the children. Therefore, it is urgent to develop a connection structure for a toy track, having reasonable structure, effective cost, more functions and higher playability, and being able to simulate the running environments more realistically.

SUMMARY OF THE INVENTION

To solve the problems in the prior art, the present invention provides a connection structure for a toy track, having reasonable structure, effective cost, more functions and higher playability, and being able to simulate the running environments more realistically, thus to train children's abilities of all aspects more comprehensively and meet the diversified demands in the toy market.

The present invention employs the following technical solution to solve the technical problem. A combined structure for a toy track is provided, including at least two groups of tracks, each group of tracks being formed by splicing a plurality of track units, sides of adjacent groups of tracks being spliced by an immediately detachable connecting member. By such an arrangement, by splicing sides of a plurality of groups of tracks by connecting members in an immediately detachable manner, a lot of consumption of material of large size may be avoided, and especially for wooden toys, the selection range of wood raw material is increased while effectively reducing the cost, which is advantageous for sustainable development. In addition, such a splicing structure results in a large change in splicing, so that the toy track may be spliced or split into a plurality of tracks having a single running trajectory. This realizes high variability, greatly improves the attractiveness of this toy track and attracts children to play with this toy track for a long term. As the detachable connecting member is convenient for disassembling, this is convenient for children to assembly the pieces together by themselves, thereby promoting their manipulation and developing their intelligence, creativity and imagination.

Preferably, the connecting member is provided thereon with at least two connectors for connecting the sides of adjacent groups of tracks. By such an arrangement, by connecting adjacent groups of tracks, the purpose of immediate assembly and disassembly is realized. Hence, it is easy for assembly and disassembly.

Preferably, each of the track units is provided with a slot, and the connectors are of a cylindrical structure and are in interference fit with the slots. By such an arrangement, inserting the connectors into the slots realizes connection, and the interference fit of the connectors with the slots allows the connectors to be fastened within the slots, thereby realizing an ideal connection and fixation effect.

Preferably, protruding portions, capable of being in interference fit with an inner wall of the slots during installation in an insertion manner, are provided on a surface of each of the connectors. By such an arrangement, by clamping the protruding portions between the connectors and the slots, the connectors are allowed to be fastened within the slots due to great frictional resistance, thereby realizing an ideal connection and fixation effect.

Preferably, grooves are formed on the connectors. By such an arrangement, the connectors with grooves are elastic and can be embedded into the slots to be fastened within the slots, which is convenient for assembly, disassembly and connection.

Preferably, barrier strips are provided on both sides of each of the track units; and the connecting member is of a Π-shaped structure, an opening of the Π-shaped connecting member is clamped between two adjacent barrier strips of adjacent track units. By such an arrangement, in another way, the cross-section of the connecting member is of a Π-shaped structure, and adjacent battier strips of two adjacent track units are embedded into the opening of the connecting member, which is convenient for connection and fixation.

Preferably, the cross-section of the connecting member is of an I-shaped structure, and two openings of the I-shaped connecting member are clamped between sides of adjacent track units, respectively. By such an arrangement, in another way, by clamping the upper and lower ends of the sides of two adjacent tracks onto the connecting member, the connecting member realizes an ideal connection and fixation effect.

Preferably, the connecting member is any one of a magic tape, a magnet and a round rod fixed on the sides of the adjacent track units or any combination thereof. By such an arrangement, any one of a magic tape, a magnet and a round rod fixed on the sides of the adjacent track units or any combination thereof may combine and connect the adjacent track units together.

Preferably, the connecting member is connected with any one of a guideboard, a signal lamp, a building module and a natural landscape module or any combination thereof. By such an arrangement, the guideboard, the signal lamp, the building module and the natural landscape module not only can play a role of decoration and have a prompting function that it has arrived at this station or this geographic position, but also may be spliced together, thereby training the manipulation of children.

Preferably, the connecting member is made of any one of metal, plastic/rubber and wood or any combination thereof.

The present invention has the following beneficial effects: the present invention is reasonable and compact in structure; by splicing sides of a plurality of groups of tracks by connecting members in an immediately detachable manner, a lot of consumption of material of large size may be avoided, and especially for wooden toys, the selection range of wood raw material is increased while effectively reducing the cost, which is advantageous for sustainable development; in addition, such a splicing structure results in a large change in splicing, so that the toy track may be spliced or split into a plurality of tracks having a single running trajectory, this realizes high variability, greatly improves the attractiveness of this toy track and attracts children to play with this toy track for a long term; in addition, the mating toy modules such as guideboards, signal lamps, building modules and natural landscape modules may be spliced together, and those modules not only play a role of decoration, but also can train the children, thereby making teaching go together with pleasure.

Figure 1:
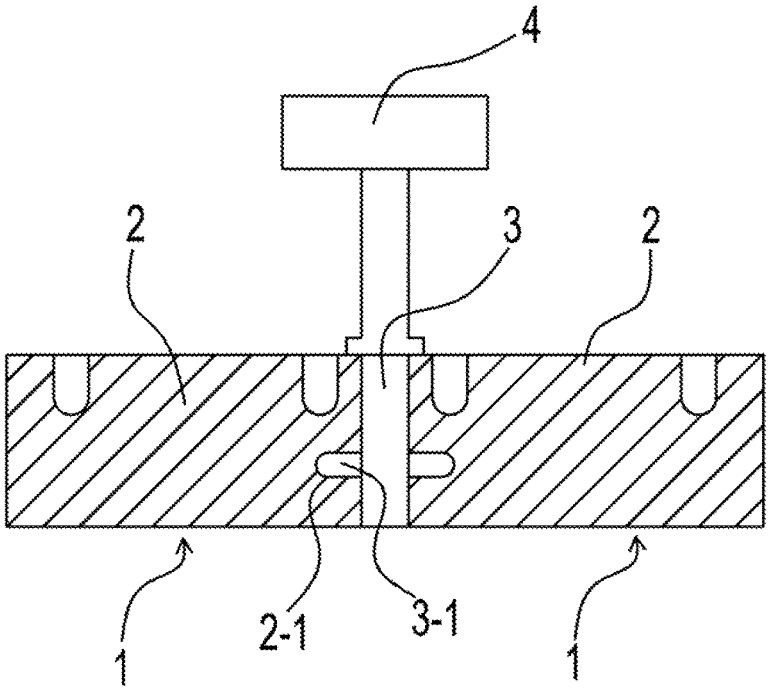
FIG. 1 is a structure diagram of Embodiment 1 of the present invention.

in which:

1: Track;
1-1: Barrier strip;
2: Track unit;
2-1: Slot;
3: Connecting member;
3-1: Connector;
3-1-1: Protruding portion;
3-1-2: Groove;
4: Guideboard;
5: Signal lamp;
6: Building module; and
7: Natural landscape module.

DETAILED DESCRIPTION OF THE INVENTION

The present invention will be further described as below with reference to the accompanying drawings.

Embodiment 1

Referring to the drawing, the connection structure for a toy track provided by this embodiment includes at least two groups of tracks 1. Each group of tracks 1 is formed by splicing a plurality of track units 2, and sides of adjacent groups of tracks 1 are spliced by an immediately detachable connecting member 3.

The connecting member 3 is provided thereon with at least two connectors 3-1 for connecting the sides of adjacent groups of tracks 1.

Each of the track units 2 is provided with a slot 2-1, and the connectors 3-1 are of a cylindrical structure and are in interference fit with the slots 2-1.

The connecting member 3 is connected with any one of a guideboard 4, a signal lamp 5, a building module 6 and a natural landscape module 7 or any combination thereof.

The connecting member 3 is made of any one of metal, plastic/rubber and wood or any combination thereof.

In FIG. 1 of this embodiment, it is shown that the connecting member 3 is connected with a guideboard 4.

Embodiment 2

Referring to the drawing, the connection structure for a toy track provided by this embodiment includes at least two groups of tracks 1. Each group of tracks 1 is formed by splicing a plurality of track units 2, and sides of adjacent groups of tracks 1 are spliced by an immediately detachable connecting member 3.

The connecting member 3 is provided thereon with at least two connectors 3-1 for connecting the sides of adjacent groups of tracks 1.

Each of the track units 2 is provided with a slot 2-1, and the connectors 3-1 are of a cylindrical structure and are in interference fit with the slots 2-1.

Protruding portions 3-1-1, capable of being in interference fit with an inner wall of the slots during installation in an insertion manner, are provided on a surface of each of the connectors 3-1.

The connecting member 3 is connected with any one of a guideboard 4, a signal lamp 5, a building module 6 and a natural landscape module 7 or any combination thereof.

The connecting member 3 is made of any one of metal, plastic/rubber and wood or any combination thereof.

When in use of this embodiment, the connectors 3-1 are inserted into the slots 2-1, and the protruding portions 3-1-1 allows the connectors 3-1 to be fastened within the slots 2-1 due to frictional resistance, thereby realizing the connection between two track units 2 and the connection between two groups of tracks 1.

Figure 2:
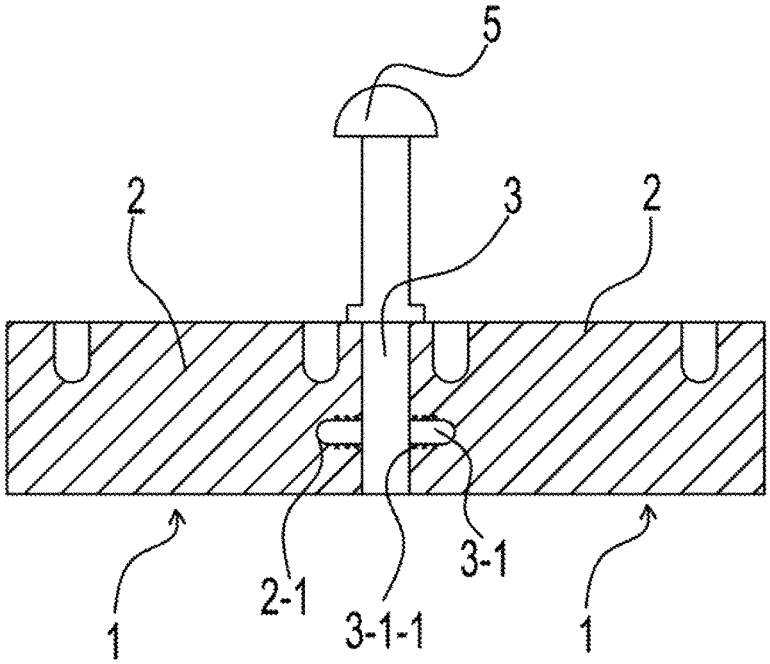
FIG. 2 is a structure diagram of Embodiment 2 of the present invention.

In FIG. 2 of this embodiment, it is shown that the connecting member 3 is connected with a signal lamp 5.

Embodiment 3

The connection structure for a toy track provided by this embodiment includes at least two groups of tracks 1. Each group of tracks 1 is formed by splicing a plurality of track units 2, and sides of adjacent groups of tracks 1 are spliced by an immediately detachable connecting member 3.

The connecting member 3 is provided thereon with at least two connectors 3-1 for connecting the sides of adjacent groups of tracks 1.

Each of the track units 2 is provided with a slot 2-1, and the connectors 3-1 are of a cylindrical structure and are in interference fit with the slots 2-1.

Grooves 3-1-2 are formed on the connectors 3-1.

The connecting member 3 is connected with any one of a guideboard 4, a signal lamp 5, a building module 6 and a natural landscape module 7 or any combination thereof.

The connecting member 3 is made of any one of metal, plastic/rubber and wood or any combination thereof.

When in use of this embodiment, the connectors 3-1 are inserted into the slots 2-1, and the connectors 3-1 are allowed to have elasticity by forming the grooves 3-1-2 on the connectors 3-1, so that the connectors 3-1 are fastened within the slots due to the elasticity, thereby realizing the connection between two track units 2 and the connection between two groups of tracks 1.

Figure 3:
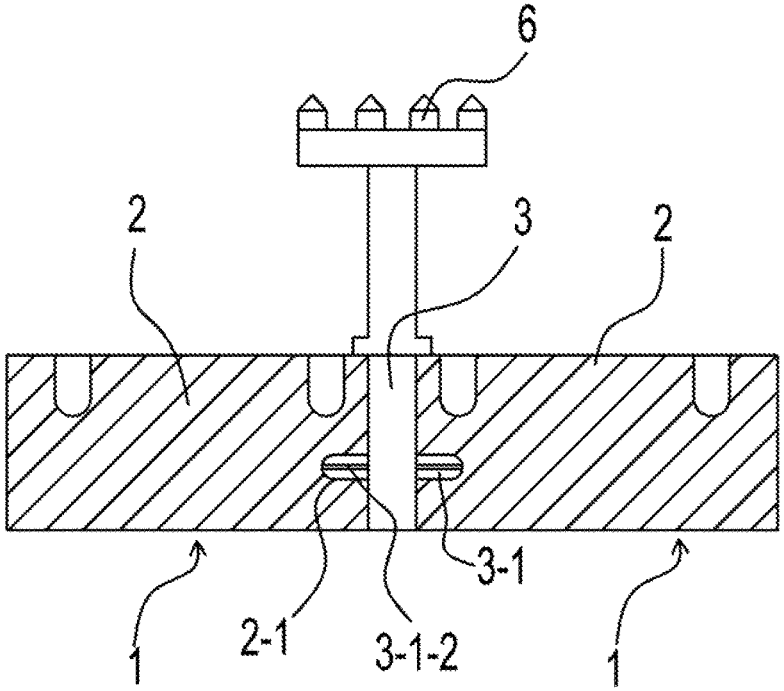
FIG. 3 is a structure diagram of Embodiment 3 of the present invention.

In FIG. 3 of this embodiment, it is shown that the connecting member 3 is connected with a building module 7.

Embodiment 4

The connection structure for a toy track provided by this embodiment includes at least two groups of tracks 1. Each group of tracks 1 is formed by splicing a plurality of track units 2, and sides of adjacent groups of tracks 1 are spliced by an immediately detachable connecting member 3.

Barrier strips 1-1 are provided on both sides of each of the track units 1; and the connecting member 3 is of a Π-shaped structure, an opening of the Π-shaped connecting member 3 is clamped between two adjacent barrier strips 1-1 of adjacent track units 2.

The connecting member 3 is connected with any one of a guideboard 4, a signal lamp 5, a building module 6 and a natural landscape module 7 or any combination thereof.

The connecting member 3 is made of any one of metal, plastic/rubber and wood or any combination thereof.

When in use of this embodiment, the barrier strips 1-1 of two adjacent track units 2 are clamped into the opening of the connecting member 3, thereby realizing the connection between two track units 2 and the connection between two groups of tracks 1.

Figure 4:
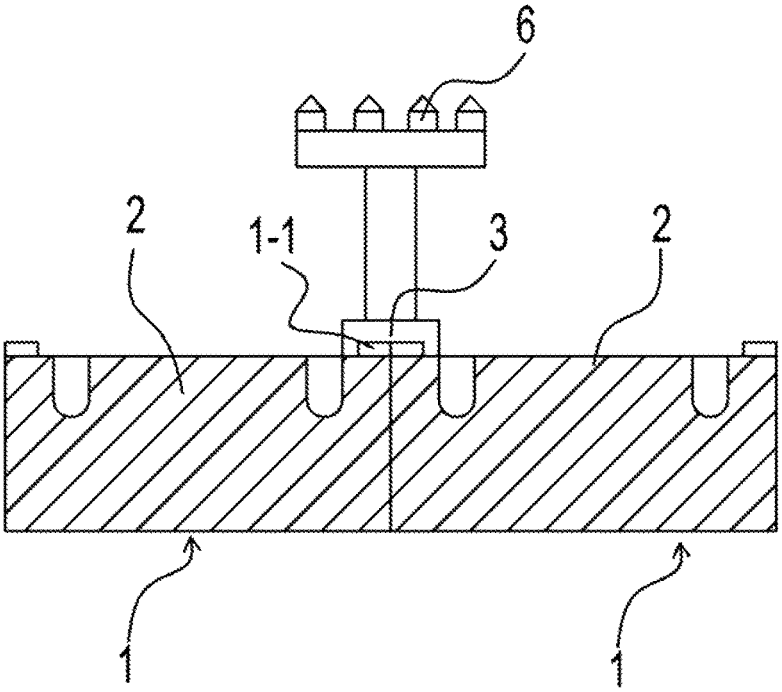
FIG. 4 is a structure diagram of Embodiment 4 of the present invention.

In FIG. 4 of this embodiment, it is shown that the connecting member 3 is connected with a building module 6.

Embodiment 5

The connection structure for a toy track provided by this embodiment includes at least two groups of tracks 1. Each group of tracks 1 is formed by splicing a plurality of track units 2, and sides of adjacent groups of tracks 1 are spliced by an immediately detachable connecting member 3.

The cross-section of the connecting member 3 is of an I-shaped structure, and two openings of the I-shaped connecting member 3 are clamped between sides of adjacent track units 2, respectively.

The connecting member 3 is connected with any one of a guideboard 4, a signal lamp 5, a building module 6 and a natural landscape module 7 or any combination thereof.

The connecting member 3 is made of any one of metal, plastic/rubber and wood or any combination thereof.

When in use of this embodiment, two openings of the I-shaped connecting member 3 are clamped between sides of adjacent track units 2, respectively, thereby realizing the connection between two track units 2 and the connection between two groups of tracks 1.

Figure 5:
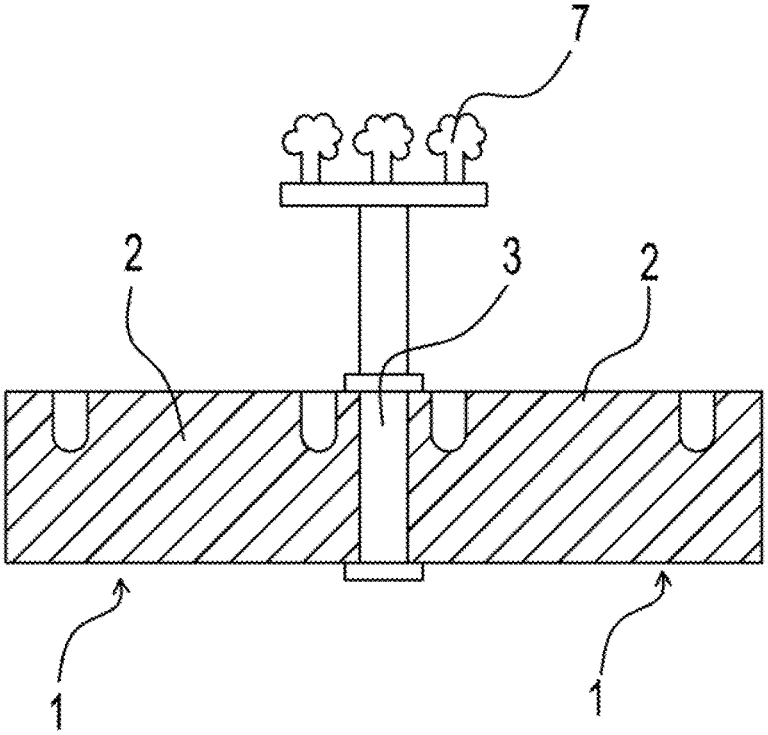
FIG. 5 is a structure diagram of Embodiment 5 of the present invention.

In FIG. 5 of this embodiment, it is shown that the connecting member 3 is connected with a natural landscape module 7.

Embodiment 6

The connection structure for a toy track provided by this embodiment includes at least two groups of tracks 1. Each group of tracks 1 is formed by splicing a plurality of track units 2, and sides of adjacent groups of tracks 1 are spliced by an immediately detachable connecting member 3.

The connecting member 3 is any one of a magic tape, a magnet and a round rod fixed on the sides of the adjacent track units 2 or any combination thereof.

The connecting member 3 is connected with any one of a guideboard 4, a signal lamp 5, a building module 6 and a natural landscape module 7 or any combination thereof.

The connecting member 3 is made of any one of metal, plastic/rubber and wood or any combination thereof.

When in use of this embodiment, two track units 2 are connected by any one of a magic tape, a magnet and a round rod or any combination thereof, thereby realizing the connection between two track units 2 and the connection between two groups of tracks 1.

Figure 6:
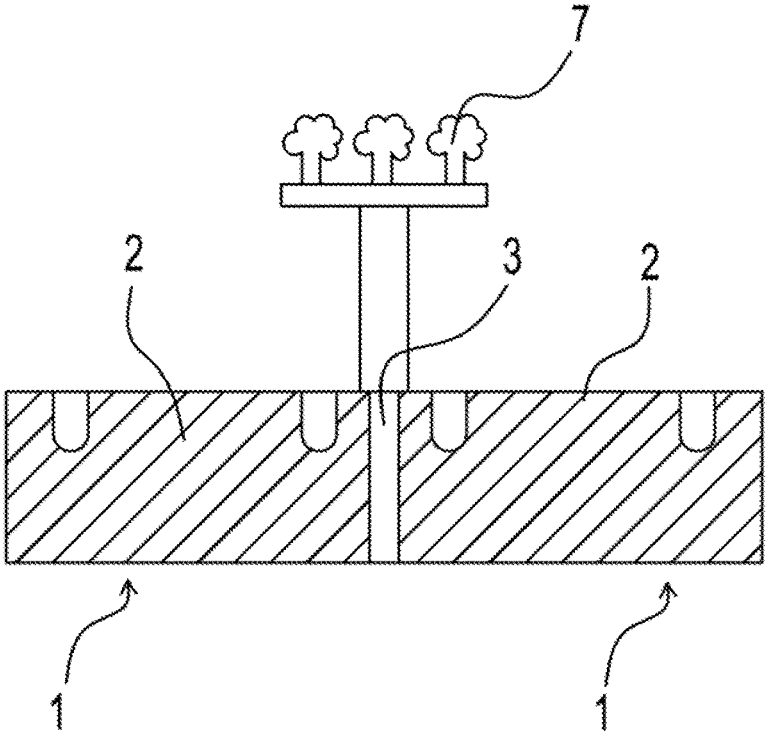
FIG. 6 is a structure diagram of Embodiment 6 of the present invention.

In FIG. 6 of this embodiment, it is shown that the connecting member 3 is connected with a natural landscape module 7.

Although the present invention has been illustrated and described with reference to the preferred embodiments, it should be understood by a person of ordinary skilled in the art that various variations in both form and detail may be made within the scope defined by the appended claims.

What is claimed is:

1. A combined structure for a toy track, comprising at least two groups of tracks (1), each group of tracks being formed by splicing a plurality of track units (2), characterized in that sides of adjacent groups of tracks (1) are spliced by a connecting member (3) having immediately detachable ability, the connecting member (3) is provided thereon with at least two connectors (3-1) for connecting the sides of adjacent groups of tracks (1), each of the track units (2) is provided with a slot (2-1), and the connectors (3-1) are of a cylindrical structure and are in interference fit with the slots (2-1), protruding portions (3-1-1), capable of being in interference fit with an inner wall of the slots during installation in an insertion manner, are provided on a surface of each of the connectors (3-1).

2. The combined structure for a toy track according to claim 1, characterized in that grooves (3-1-2) are formed on the connectors (3-1).

3. The combined structure for a toy track according to claim 1, characterized in that barrier strips (1-1) are provided on both sides of each of the track units (2); and the connecting member (3) is of a H-shaped structure, an opening of the Π-shaped connecting member (3) is clamped between two adjacent barrier strips (1-1) of adjacent track units (2).

4. The combined structure for a toy track according to claim 1, characterized in that the cross-section of the connecting member (3) is of an I-shaped structure, and two openings of the I-shaped connecting member (3) are clamped between sides of adjacent track units (2), respectively.

5. The combined structure for a toy track according to claim 1, characterized in that the connecting member (3) is any one of a magic tape, a magnet and a round rod fixed on the sides of the adjacent track units (2) or any combination thereof.

6. The combined structure for a toy track according to claim 1, characterized in that the connecting member (3) is connected with any one of a guideboard (4), a signal lamp (5), a building module (6) and a natural landscape module (7) or any combination thereof.

7. The combined structure for a toy track according to claim 1, characterized in that the connecting member (3) is made of any one of metal, plastic/rubber and wood or any combination thereof.

* * * * *